United States Patent [19]

Shiozawa

[11] Patent Number: 4,504,053

[45] Date of Patent: Mar. 12, 1985

[54] PAPER FEEDING MEANS FOR RECORDING APPARATUS

[75] Inventor: Takao Shiozawa, Hachioji, Japan

[73] Assignee: Konishiroku Photo Industry Co., Ltd., Tokyo, Japan

[21] Appl. No.: 343,514

[22] Filed: Jan. 28, 1982

[30] Foreign Application Priority Data

Feb. 19, 1981 [JP] Japan ..... 56-23502
Apr. 25, 1981 [JP] Japan ..... 56-63159

[51] Int. Cl.[3] ..... B65H 3/04

[52] U.S. Cl. ..... 271/34; 271/157; 271/164

[58] Field of Search ..... 271/157, 162, 164, 145, 271/34

[56] References Cited

U.S. PATENT DOCUMENTS 4,060,233 11/1977 Stange ..... 271/164 X
4,219,192 8/1980 Burke ..... 271/164 X

*Primary Examiner*—Richard A. Schacher
*Attorney, Agent, or Firm*—Jordan B. Bierman

[57] ABSTRACT

An electrophotographic copying machine is placed upon a pedestal type supplementary paper feeding device which includes a base table supporting a paper containing bin having a pallet which rests upon a lift on the base table. The bin has a cut-out section through which the lift moves against the pallet for raising the stacked paper to a feeding mechanism at the top of the lift for supplying paper to the copying machine.

3 Claims, 8 Drawing Figures

PAPER FEEDING MEANS FOR RECORDING APPARATUS

BACKGROUND OF THE INVENTION

1. Field of the Invention

The present invention relates to an electrophotographic paper feeding means for supplying recording paper to be used in a recording apparatus.

2. Description of the Prior Art

Paper feeding means have been proposed by the present inventor in Japanese Patent Application No. 149978/1980, wherein recording papers stored in a bin or vessel are raised together with a pallet by means of a lift, and the recording paper sheets are then fed out one by one by means of a paper feeding unit positioned on the upper part of the bin.

The present inventor has found after more study of the above construction, that while the said construction is basically satisfactory, it has the following inconveniences in practical use. First, in the case when the recording papers are raised to the level of a paper feeding unit by means of a lift, there exists a large frictional resistance between said recording papers and the container, and consequently, there are some instances where the relatively lightweight container is raised together with the recording paper insecurely falls off and the neatly arranged recording papers become disordered, and there are also some instances where an impulsive force is applied to the paper feeding means and an erroneous operation such as multi-feeding is caused. In the aforementioned construction, a container can be removed at any time during the paper feeding operation regardless of the ascent and descent of the lift; therefore, the container is insecurely lifted by the user and the neatly arranged recording papers become disordered, and making it necessary to put them in order again. Furthermore in case a bin containing heavy recording papers is removed from the receiving table, a user is apt to take it out with making it slide on the receiving table, and in such a case, there is the possibility of dropping the bin from the user's hands, disorganizing the recording papers, or inflicting an injury on a person.

SUMMARY OF THE INVENTION

It is an object of the invention to provide a paper feeding means in which the container or bin is securely lifted in operation, and is also simply detachable.

It is another incidental object of the invention to provide a paper feeding means, wherein the container cannot be removed from the receiving table during the paper feeding operation or in the ascent or descent of the lift, and the container can be prevented from dropping when it is removed.

The above objects of the present invention are achieved by a paper feeding means from which recording paper is supplied one by one to a recording apparatus, said paper feeding means comprising, a horizontal receiving table for fixing to the fixed section of said means, a container for storing a pallet which can be piled up with recording paper and for resting slidably on said receiving table, a lift which leaves said container on the receiving table while lifting the recording papers piled on said pallet, a means for preventing said container from raising by attaching the same to said receiving table when the container is properly positioned thereon, and a paper feeding unit at the upper part of said receiving table for feeding the uppermost sheet of the recording papers raised by said lift to the outside of said paper feeding means.

BRIEF DESCRIPTION OF THE DRAWING

Referring to FIG. 1, there is shown a pedestal type paper feeding means Z to be used as an auxiliary equipment for an electrophotographic copying machine Y. Electrophotographic copying machine Y is equipped with two paper feeding cassettes 1A and 1B, each of which accommodates a different size of recording paper; the recording paper necessary for copying is selectively supplied from either one of these paper feeding cassettes 1A and 1B. Paper feeding means Z is equipped with a paper ejecting exit b which is connectable to paper feeding path of the electrophotographic copying machine Y, and it supplies recording paper X as occasion demands from said paper ejecting exit b to the electrophotographic copying machine Y.

FIG. 2 and FIG. 3 illustrate the internal structure of paper feeding means Z respectively. The frame 2 comprises central wall plate **2*a* and right and left side plates 2*b* and 2*c*, and the approximately horizontal receiving table 4 equipped so as to rest container 3 thereon. Container 3 of which the central portion of front wall 3*a* and a portion of bottom plate 3*b* are open, is made in form of a box which is open at the top so as to store recording papers X, and on bottom plate 3*b* and pallet 5 in which the recording papers X rest. A pair of guide members 6A and 6B, extending from front to rear (in the direction of the arrow A), are fixed onto the upper surface of said receiving table 4, and when container 3 is slidably positioned on said receiving table 4, sliding members 7A and 7B (shown in FIG. 3) formed beneath plate 3*b* of vessel 3 are guided by said members 6A and 6B**.

Figure 3:
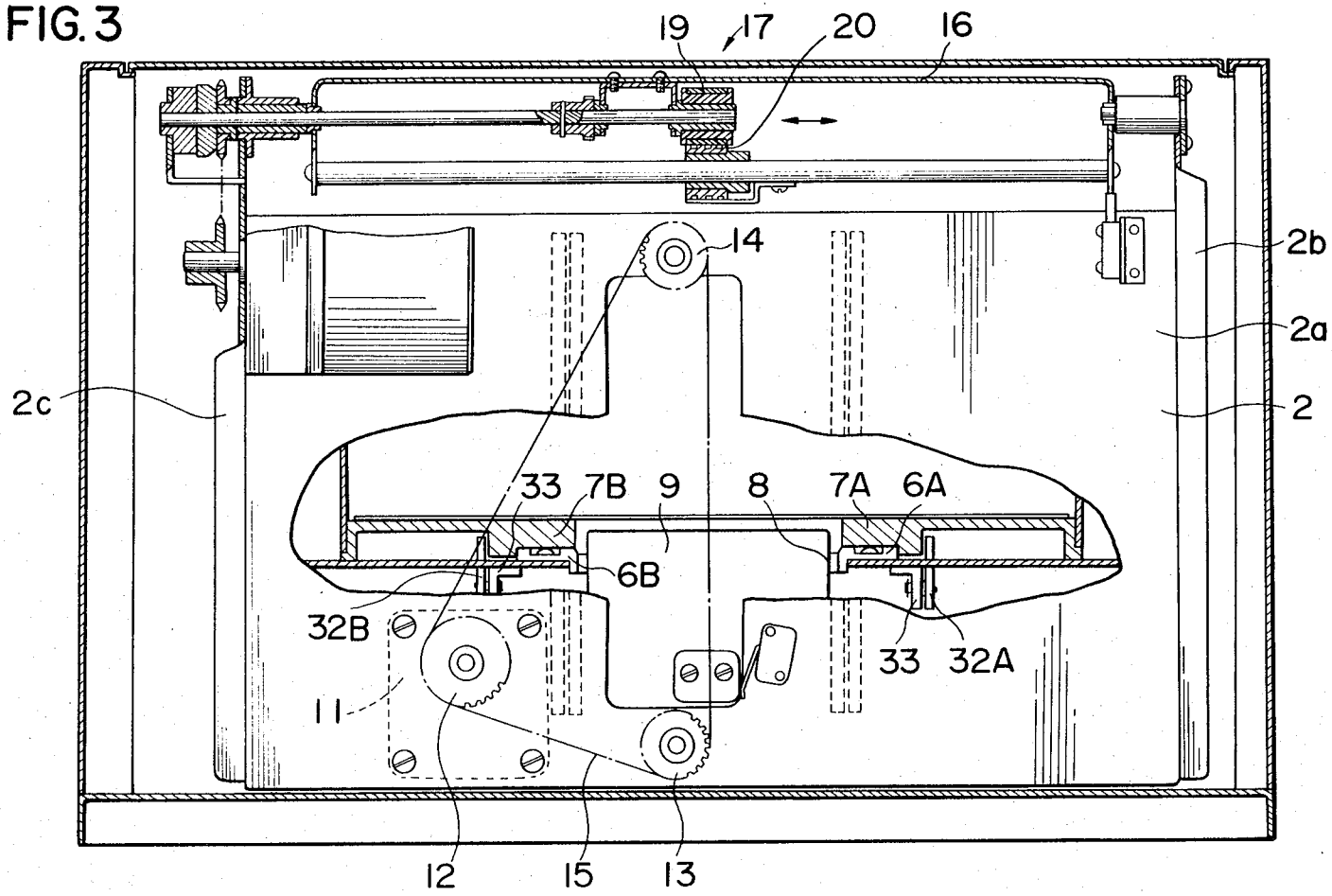
FIG. 3 is a rear view of said paper feeding means partially in cross section.

In the center of the receiving table 4, an open area 8 is formed where the open areas of front wall **3*a* and bottom plate 3*b* of vessel 3 correspond, and in the open area 8, a raise 9 is positioned to lift recording papers X which have been placed on pallet 5. The lift 9 can travel vertically along rails 10A and 10B fixed on the surface of a central wall 2*a*, and as shown in FIG. 3, it is driven by means of a chain 15 suspended about a driving sprocket 12 and intermediate sprockets 13 and 14; a driving motor 11 is appropriately mounted on the back of the central wall 2*a*. In the upper part of the receiving table 4, a paper feeding unit 17 is carried by member 16 which is pivotally supported by right and left side plates 2*b* and 2*c*. paper feeding unit 17 is formed with paper feeding roller 18 which comes into contact with the surface of recording paper X and feeds it, an endless conveyor belt 19 which receives recording paper X from said paper feeding rollers 18 and a paper resistration roller 20 which is brought into pressure contact with the surface of the conveyor belt 19** and separates multi-fed recording papers X.

Figure 4:
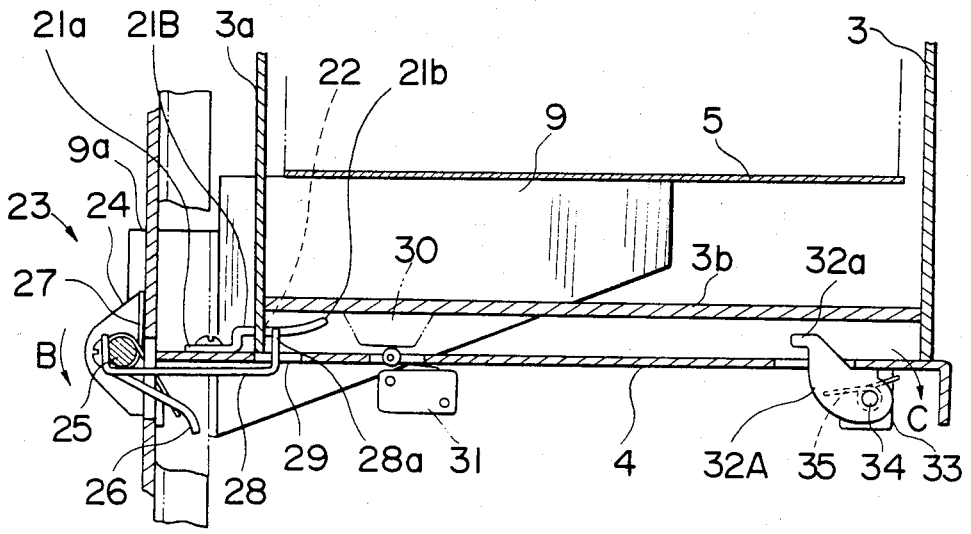
FIG. 4 is a sectional view of said paper feeding means.
Figure 5:
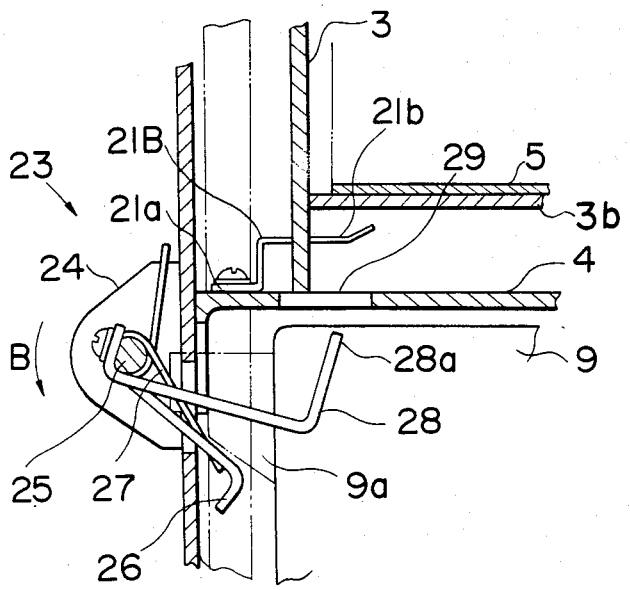
FIG. 5 and FIG. 6 are enlarged sectional views of the basic parts of said paper feeding means.

According to the present invention, on the upper surface of the front edge of receiving table 4 there are positioned a pair of checking claws 21A and 21B each of whose base **21*a* is attached to receiving table 4. Each end 21*b* of the checking claws 21A and 21B is bent in shape of a hook, and on the lower edges of the front wall 3*a* of vessel 3 corresponding to said ends 21*b*, slots 22 are formed so as to receive said ends 21*b* respectively. On the back of the central wall 2*a*, extraction prevention unit 23 which is sensitive to the position of lift 9 is assembled. Extraction prevention unit 23 is provided, as shown in FIG. 4 and FIG. 5, with a horizontal shaft 25 rotatably supported by a fitting bracket 24 mounted on the back of the central wall 2*a*, and to said horizontal shaft 25 is attached a driven lever 26 whose end 26*a* lies within the range of the movement of a protuberance 9*a* of the lift 9. Horizontal shaft 25 is urged in the direction of arrow B by means of a spring 27 suspended thereon. Horizontal shaft 25 also supports the base of locking lever 28 which is made in the shape of letter "L", and the end 28*a* of said locking lever 28 normally penetrates the square hole 29 formed on the receiving table 4. Accordingly, when lift 9 is not at the lowermost position and driven lever 26 does not sense protuberance 9*a*, the horizontal shaft 25 is rotated in the direction of arrow B and point 28*a* of locking lever 28 protrudes into square hole 29 of receiving table 4. On receiving table 4, microswitch 31 is provided to sense a cam 30 which is mounted on the bottom of container 3, and said microswitch 31 is connected into the driving circuit of lift 9 and said lift 9 is arranged so as not to ascend unless otherwise sensed by microswitch 31**.

Figure 6:
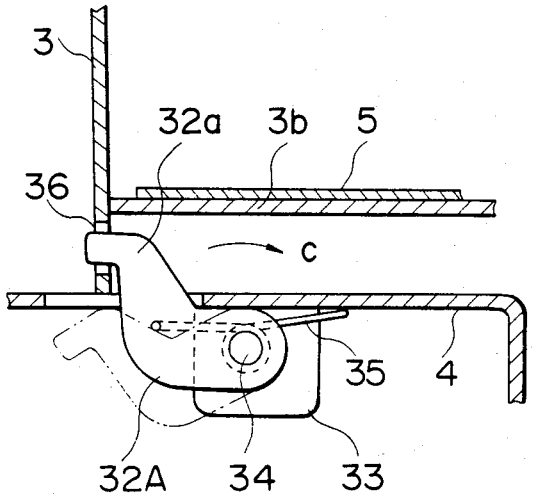

Furthermore, at the position a little to the rear end of the receiving table 4, there are provided a pair of drop prevention claws 32A and 32B which are freely retractable from said receiving table 4. In other words, they are, as shown in FIG. 6, pivotally suspended by pin 34 of supporting piece 33 and also urged by spring 35 in the direction of arrow C. End **32*a* of drop prevention claws 32A and 32B are bent in the shape of a hook and protrude from receiving table 4 through the hole 35*a* of receiving table 4. Also, on front wall 3*a* of bin 3 corresponding to ends 32*a*, coupling holes 36 are formed through which the coupling can be made to said ends 32*a*, and when vessel 3 is extracted from receiving table 4 in the horizontal direction, said coupling hole 36 is arranged so that point 32*a*** can be coupled thereto.

The means of the aforesaid example has the structure to place bin 3 containing recording papers X in a paper feeding position slidably resting the same on the receiving table 4 will suffice for this purpose. In this case, ends **32*a* of drop prevention claws 32A and 32B protrude from receiving table 4; however these drops prevention claws 32A and 32B are retracted beneath receiving table 4 as taken on an hypothetical line in FIG. 6, and moreover lift 9 descends beneath receiving table 4 as shown in FIG. 5, and locking lever 28 also falls beneath receiving table 4, and therefore, vessel 3 can be slid into the position shown in FIG. 5 without any resistance. Furthermore, in this position, microswitch 31 senses cam 30 and lift 9 can be raised and then checking claws 21A and 21B are coupled to slots 22 of container 3**.

Next, when recording papers X are raised together with pallet 5 by means of lift 9, driven lever 26 is released from protuberance **9*a* as shown in FIG. 4, and end 28*a* of locking lever 28 consequently protrudes from receiving table 4 and checks the movement for the rear of front wall 3*a* of vessel 3. In other words, vessel 3 cannot be removed from receiving table 4 if lift 9 does not return to the lowermost position. And, when lift 9 has risen, friction force is produced between the surface of vessel 3 and recording papers X, however, the paper feeding function is not interferred by erroneous lifting of vessel 3, because of the fact that vessel 3 is prevented from lifting by the coupling of checking claws 21A and 21B to slot 22**.

Furthermore, to remove vessel 3 from receiving table 4, the return of lift 9 to the lowermost position will suffice as shown in FIG. 5. That is to say, locking lever 28 descends beneath receiving table 4 by the return of lift 9 and thus one can extract bin 3. However, when the bin 3 is extracted, ends **32*a* of drop prevention claws 32A and 32B engage holes 36 of vessel 3 as shown in FIG. 6. Accordingly, to remove vessel 3, it is necessary to put back container 3 a little and to give it a lift by hand relieving the weight of recording papers X, and thus no dropping of vessel 3** will arise from a careless handling.

A detailed description of the preferred example of the container 3 of the present invention will be made with reference to FIG. 7 and FIG. 8.

Figure 1:
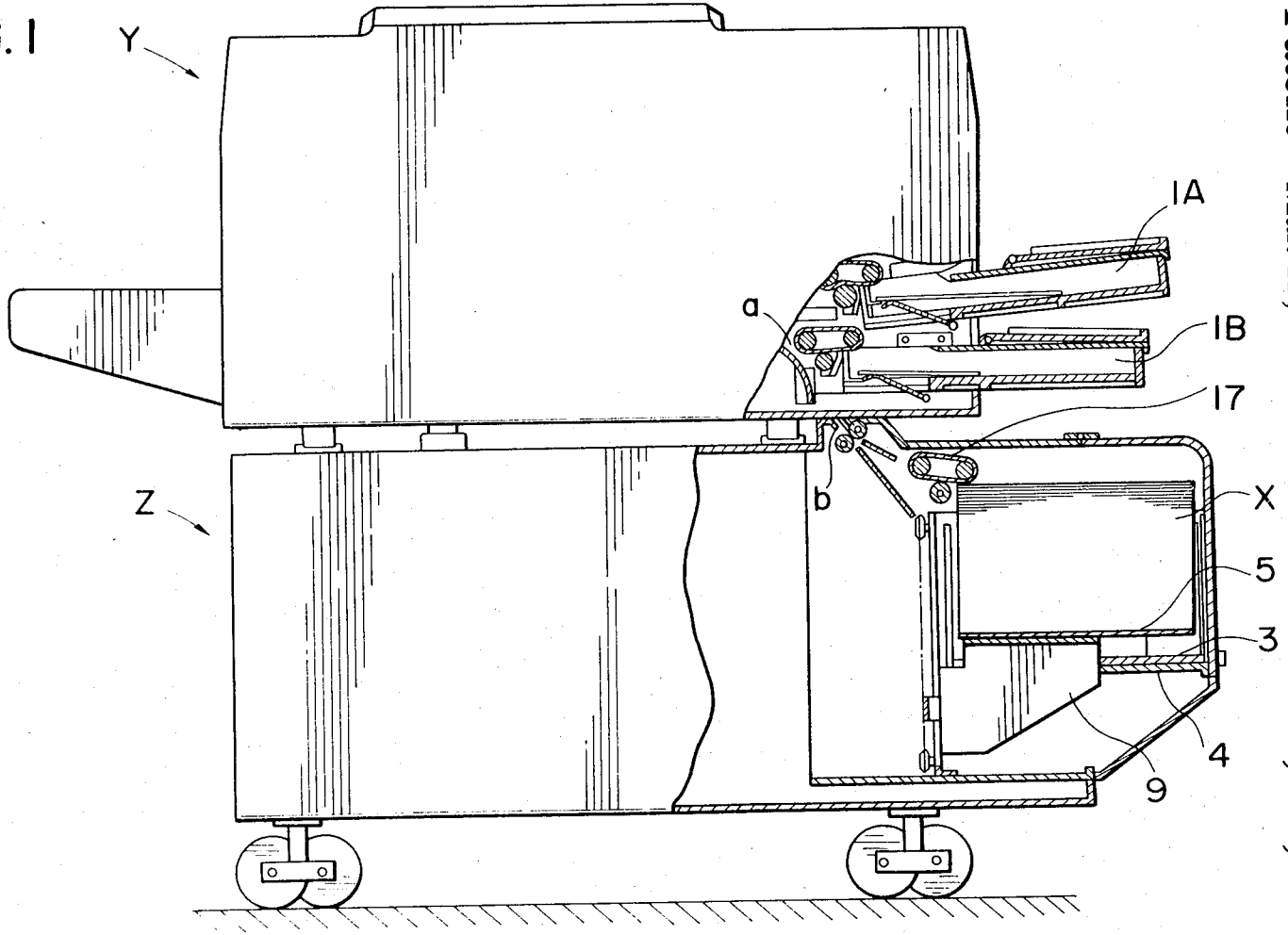
FIG. 1 is a partially cutaway side view of a paper feeding means of the present invention, which is to be jointly used with a copying machine.
Figure 2:
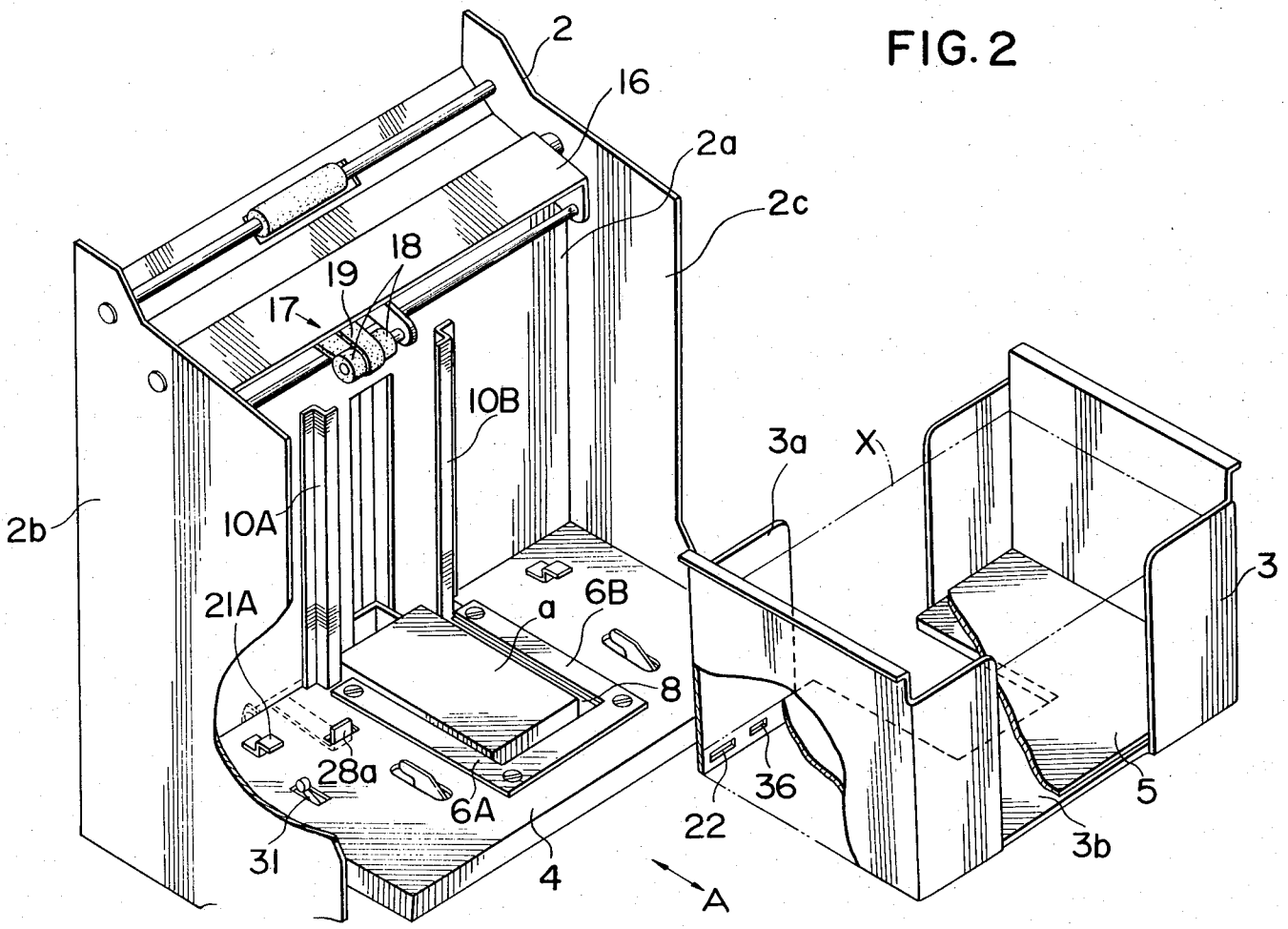
FIG. 2 is a perspective view showing the internal structure of said paper feeding means.
Figure 7:
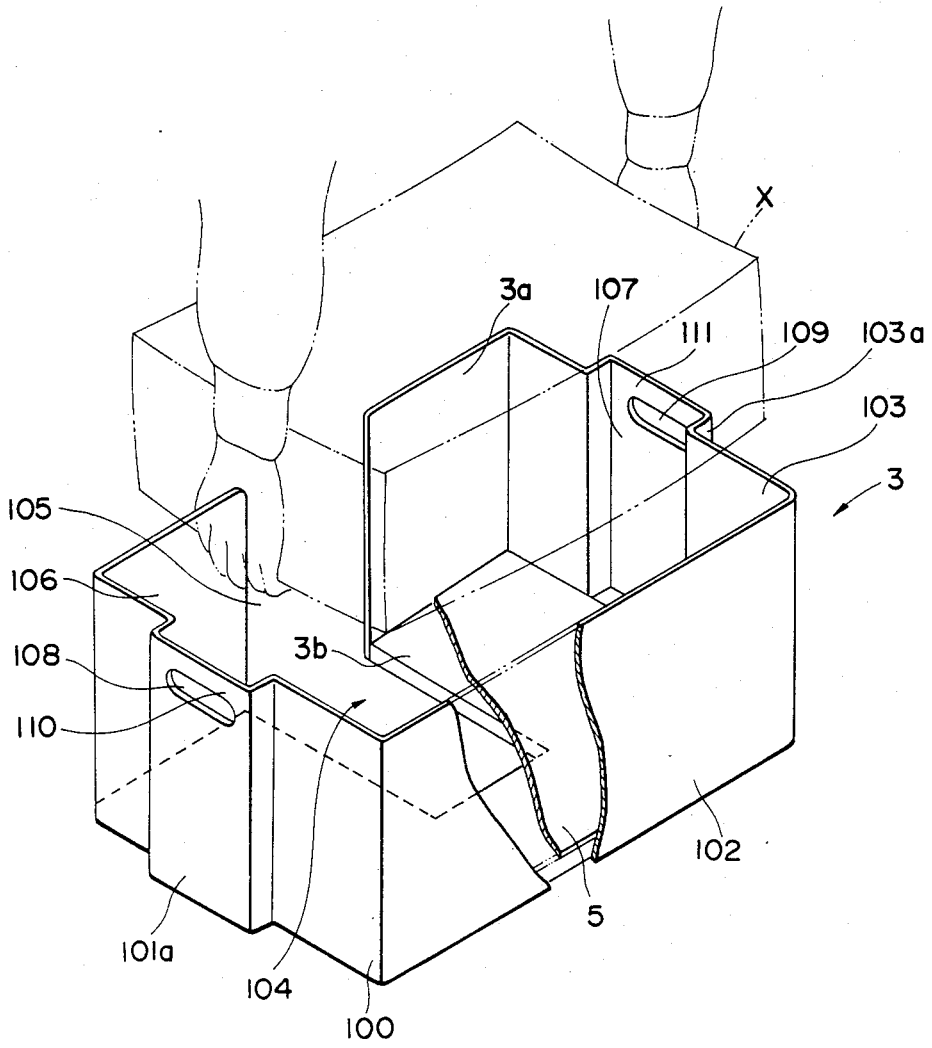
FIGS. 7 and 8 are perspective views of a different container for use with the paper feeding means of the present invention.

FIG. 7 illustrates a preferred example of the invention in which the surrounding portions thereof other than container 3 of the present invention are omitted. The container 3 has bottom plate **3*b* which is to be placed on the base board, and the four sides of said bottom plate 3*b* are enclosed with side walls, 3*a*, 100, 102, and 103, respectively, and the whole body thereof is made in form of a box of which the upper part is open. At the center of said bottom plate 3*b* and the side wall 3*a*, cut-openings, 104 and 105, are formed respectively to accept lift 9 (see FIG. 2), through which lift 9** can be raised.

On the other hand, each of the central portions of side walls 100 and 103 in the opposite sides of container 3 are expanded outwardly, and those expanded portions **101*a* and 103*a* form open portions 106 and 107 which extend vertically so that the palm of the hand can reach therein. Furthermore, in the example shown in FIG. 7, in the upper part of respective expanded portions 101*a* and 103*a* of each of side walls 100 and 103, there are open slots 108 and 109 into which the finger tips can be thrust and hanging grips, i.e., handles 110 and 111, are thus formed in each upper part of expanded portions 101*a* and 103*a*, by said slots 108 and 109**, respectively.

The above example was constructed as described above, therefore, to store recording papers X in the vessel 3 one applies his palms on both side-edges of said recording papers X respectively, as shown by the postulated line in the FIGURE, while supporting the weight of recording papers X by his finger tips and with thrusting his palms into openings 106 and 107 of the vessel 3, then he drops recording papers X into said bin 3. Consequently, in accordance with this procedure, it is possible to store recording papers X in the bin 3 without disturbing the edges of recording papers X which have been trued up. For carrying the container 3 holding recording papers X or for detaching them from the receiving table 4, it is possible to handle the recording papers without any danger of dropping them. Also in this case, because openings 106 and 107 are formed, there is no touching of the finger tips onto the side of recording papers X and no disorder of aligned papers. Further, it is safe and easy to handle because the finger tips can be deeply thrust into slots 108 and 109.

Figure 8:
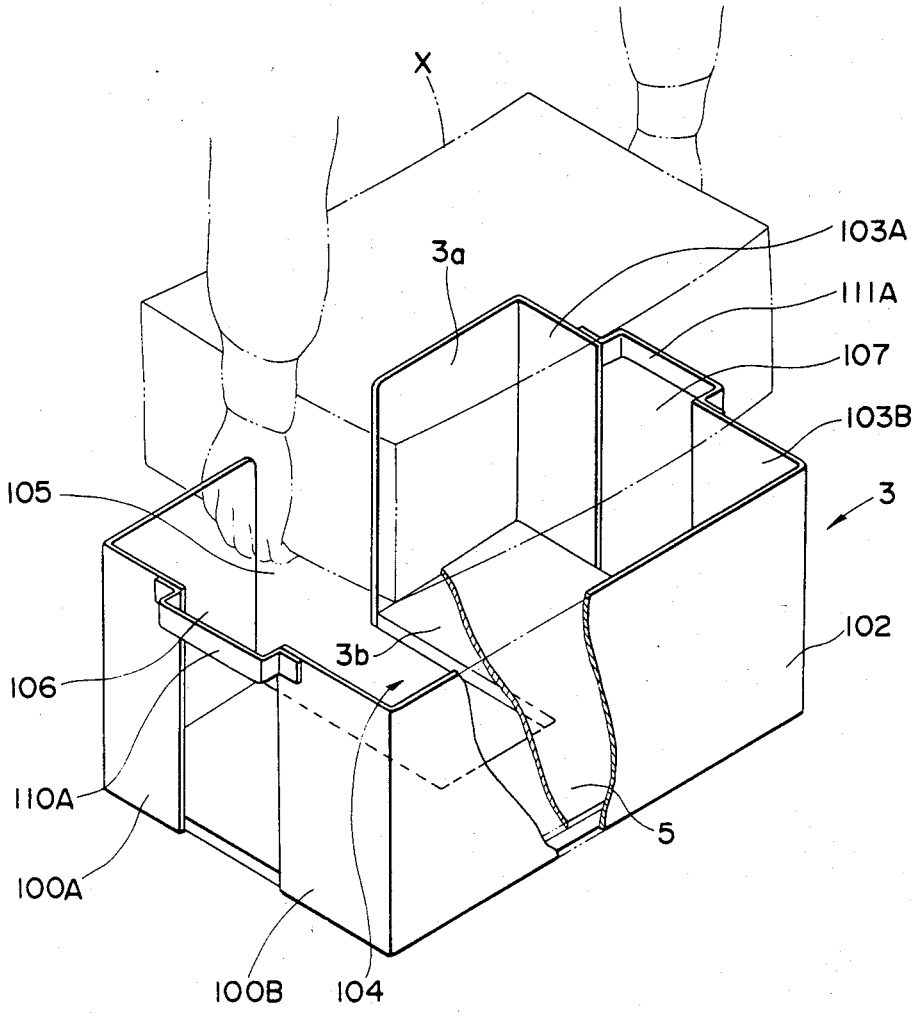

FIG. 8 is another example of the present invention, wherein the identical structures thereof to those shown in FIG. 7 are marked with identical signs to those in FIG. 7. The characteristics of the example illustrated in FIG. 8 are that it is not provided with the previously mentioned expanded portions 101*a* and 103*a* but that side walls 100 and 103 are divided into two, that is, side walls 100A, 100B, 103A and 103B, respectively and opening portions 106 and 107 are joined respectively by U handles 110A and 111A which make fast the upper edges of side walls 100A and 103A to those of side walls 100B and 103B, respectively. It is obvious also that it is possible to obtain the operational effects similar to those obtainable in the example shown in FIG. 7, if it is constructed as described above.

Consequently, in accordance with the present invention, it is possible to provide a paper feeding means having the constructure that a container can easily be detached and that a lightweight container is not erroneously lifted in paper feeding operation.

What is claimed is:

1. In an electrophotographic copying apparatus, the improvement consisting of a supplemental paper feeding device for supplying sheets of recording paper, one by one to the copying apparatus, said device including a receiving table having vertically extending front and side walls, a lift having a platform and means raising and lowering said platform between said table and a position near the top of said walls, an open top container having side walls and a base having an opening therein substantially corresponding to the dimensions of said lift platform, a pallet positioned within said container for receiving stacked sheets of recording paper, means for positioning said container on said table within said vertically extending walls so that the opening in its base corresponds to the top of said platform, means for detachably holding said container on said receiving table including locking means for locking said container to said receiving table when said lift is in other than its lowermost position, whereby the raising or lowering of said lift raises and lowers said pallet and the papers supported thereon, feeding means positioned between the vertical side walls extending from said table for feeding papers from said device when said pallet and the papers supported thereon are raising into contact with said feeding means, and means in said copying apparatus for receiving the papers so fed.

2. In an electrophotographic copying apparatus, the improvement according to claim 1 in which the means raising and lowering said platform lift include vertical guides mounted on the inner side of said vertical front wall extending from said table.

3. In an electrophotographic copying apparatus according to claim 1, in which said improvement includes providing expanded sections in the opposed side walls of said container for permitting the physical grasping of the stack of recording papers therein.

* * * * *